US008630328B2

(12) United States Patent
Naitoh et al.

(10) Patent No.: US 8,630,328 B2
(45) Date of Patent: Jan. 14, 2014

(54) MELTING FURNACE

(75) Inventors: Satoshi Naitoh, Chigasaki (JP); Ichiro Mukae, Chigasaki (JP)

(73) Assignee: Ulvac, Inc., Chigasaki-Shi (JP)

( * ) Notice: Subject to any disclaimer, the term of this patent is extended or adjusted under 35 U.S.C. 154(b) by 305 days.

(21) Appl. No.: 13/120,790

(22) PCT Filed: Sep. 25, 2009

(86) PCT No.: PCT/JP2009/004850

§ 371 (c)(1),
(2), (4) Date: Mar. 24, 2011

(87) PCT Pub. No.: WO2010/035471

PCT Pub. Date: Apr. 1, 2010

(65) Prior Publication Data

US 2011/0176576 A1 Jul. 21, 2011

(30) Foreign Application Priority Data

Sep. 26, 2008 (JP) ..... P2008-248086

(51) Int. Cl.

| | |
|---|---|
| ***F27D 7/06*** | (2006.01) |
| ***F27D 3/00*** | (2006.01) |
| ***H05B 6/02*** | (2006.01) |
| ***H05B 6/22*** | (2006.01) |
| ***H05B 11/00*** | (2006.01) |

(52) U.S. Cl.

USPC ..... 373/141; 373/140; 373/143; 373/138; 373/154; 373/7

(58) Field of Classification Search

USPC ..... 373/138, 139, 140, 142, 78, 68, 143, 373/151, 154, 7, 141, 113; 432/4, 27, 82; 165/58–61, 64–66

See application file for complete search history.

(56) References Cited

U.S. PATENT DOCUMENTS 4,592,538 A * 6/1986 Wells, III ..... 266/216
4,773,079 A * 9/1988 Bruckmann et al. ..... 373/141

(Continued)

FOREIGN PATENT DOCUMENTS

CN 2690415 4/2005
DE 4207694 9/1993

(Continued)

OTHER PUBLICATIONS

Notice of Allowance from corresponding Russian Application No. 2011115816 dated Sep. 26, 2012. English translation attached.

(Continued)

*Primary Examiner* — Tu B Hoang
*Assistant Examiner* — Hung D Nguyen
(74) *Attorney, Agent, or Firm* — Grossman, Tucker, Perreault & Pfleger, PLLC

(57) ABSTRACT

A melting furnace including a sealed container containing an inert gas atmosphere, a crucible that is located inside the sealed container and melts a raw material by induction heating, and a crucible cooling mechanism. The crucible cooling mechanism includes a pipe portion that includes an intake that communicates with the sealed container and enables the inert gas to be discharged from the sealed container, and an outlet that enables the inert gas to be introduced into the sealed container, a heat exchange portion that is located partway along the pipe portion, and a gas transporting portion that is located partway along the pipe portion.

10 Claims, 1 Drawing Sheet

(56) References Cited

U.S. PATENT DOCUMENTS

| | | | | |
|---|---|---|---|---|
| 5,334,232 | A * | 8/1994 | France et al. | 65/388 |
| 5,343,492 | A * | 8/1994 | Henn | 373/143 |
| 5,753,004 | A * | 5/1998 | Hanai et al. | 373/7 |
| 6,049,559 | A * | 4/2000 | Abiko et al. | 373/140 |
| 2007/0147462 | A1 * | 6/2007 | Wilcox et al. | 373/113 |

FOREIGN PATENT DOCUMENTS

| | | |
|---|---|---|
| EP | 1118684 | 3/2003 |
| GB | 2265805 | 10/1993 |
| JP | 62-153683 | 7/1987 |
| JP | 1-155186 | 6/1989 |
| JP | 8-252650 | 10/1996 |
| SU | 491811 | 11/1975 |
| SU | 1071359 | 2/1981 |

OTHER PUBLICATIONS

International Search Report from corresponding PCT Application No. PCT/JP2009/004850 dated Dec. 8, 2009.

Office Action from corresponding Chinese Appln. No. 200980137691.7 dated Jan. 24, 2013. English translation attached.

Office Action from corresponding German Appln. No. 112009002335.5 dated Mar. 6, 2013. English translation attached.

* cited by examiner

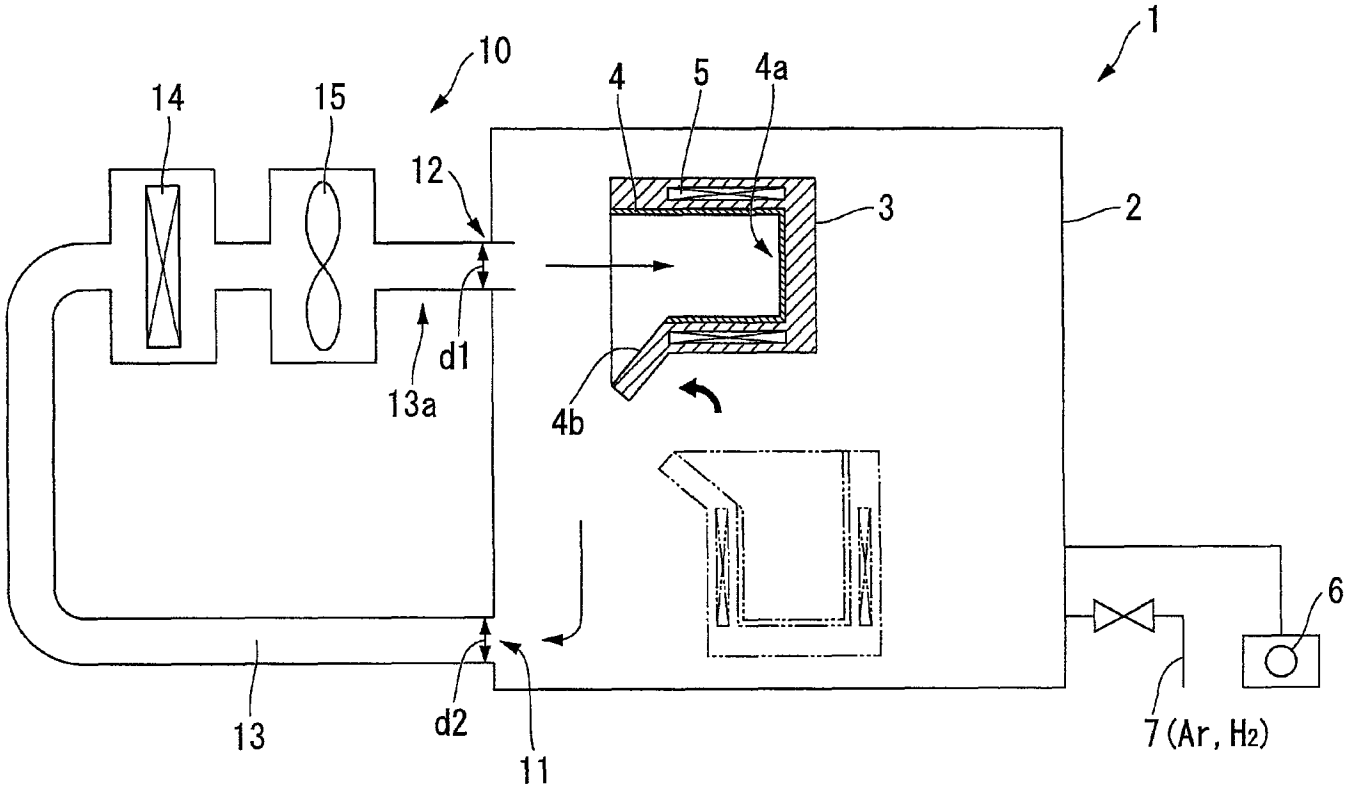
1
2
3
4a
5
4
4b
6
7 (Ar, H2)
10
12
d1
13a
15
14
11
d2
13

MELTING FURNACE

TECHNICAL FIELD

The present invention relates to an induction heating type of melting furnace. Specifically, the present invention relates to a melting furnace that is capable of rapidly lowering the crucible temperature after melting and heating.

Priority is claimed on Japanese Patent Application No. 2008-248086, filed Sep. 26, 2008, the contents of which are incorporated herein by reference.

TECHNICAL BACKGROUND

A crucible formed from a high melting point metal is used to melt lumps of rare earth metallic raw material so as to cast them into ingots, or to melt and refine rare earth oxide raw materials using the heat reduction of calcium. These processes are performed in a vacuum melting furnace. Specifically, these processes are performed by first placing a crucible containing the raw materials in a vacuum furnace. Air is then expelled from the vacuum furnace and the vacuum furnace is refilled with an inert gas (i.e., argon or the like). Induction heating is used for the melting (see, for example, Patent document 1).

In an induction heating type of melting furnace of a related art, once a melting furnace melts a material, it is necessary for the crucible to be cleaned. However, because the temperature inside a crucible after the melting and heating is extremely high, maintenance work cannot begin until the temperature cools enough to allow maintenance work to be carried out. This places severe restrictions on the work cycle.

Previously, the cooling of a crucible after melting and heating has relied on heat conduction generated by the flow of cooling water inside a coil that is used for the induction heating, or on radiation from the surface of the crucible. Because the cooling obtained from heat conduction occurs via an insulating material, it is extremely weak and, in actuality, almost all of the cooling is achieved through radiation. In cooling achieved through radiation in this manner, considerable time is required until the crucible cools sufficiently and this thwarts any attempt to improve the work cycle.

DOCUMENTS OF THE PRIOR TECHNOLOGY

Patent Documents

[Patent Document 1] Japanese Unexamined Patent Application First Publication No. H08-252650

DISCLOSURE OF THE INVENTION

Problems to be Solved by the Invention

The present invention was achieved in view of the above described previous situation and it is an object thereof to provide a melting furnace that enables a crucible to be cooled efficiently after melting and heating, and that enables the work cycle to be improved.

Means for Solving the Problem

A melting furnace according to an embodiment of the present invention includes: a sealed container containing an inert gas atmosphere; a crucible that is located inside the sealed container and melts a raw material by induction heating; and a crucible cooling mechanism, wherein the crucible cooling mechanism includes: a pipe portion that includes an intake that communicates with the sealed container and that enables the inert gas to be discharged from the sealed container, and an outlet that enables the inert gas to be introduced into the sealed container; a heat exchange portion that is located partway along the pipe portion; and a gas transporting portion that is located partway along the pipe portion.

The gas transporting portion of the crucible cooling mechanism may be located upstream or downstream from the heat exchange portion.

An inner diameter of the outlet may be smaller than an inner diameter of the intake.

The outlet may blow the inert gas at a greater flow rate than the intake.

The crucible may tilt around a tilt axis so as to switch between a melting state and a pouring state.

The crucible may includes an inside bottom surface and a spout portion from which the melted raw material poured out.

The outlet may be positioned facing an inside bottom surface of the crucible when the crucible is in a pouring state, and the intake may be positioned closer to a bottom surface side of the sealed container than is a spout portion of the crucible, when the crucible is in the pouring state.

When the crucible is in the pouring state and the spout portion is facing towards the bottom surface side of the sealed container, the intake may be positioned below the spout portion of the crucible.

The intake may be positioned below a spout portion of the crucible in a direction which the melted raw material is poured out.

The outlet may be positioned such that the inert gas discharged from the outlet is blown onto an area within 40% of a diameter from a center of the inside bottom surface of the crucible.

The heat exchange portion and the gas transporting portion of the crucible cooling mechanism may be located between the intake and the outlet of the pipe portion.

The heat exchange portion may have a heat exchanger and the gas transporting portion may have a fan.

Effects of the Invention

The melting furnace according to the present invention has a crucible cooling mechanism that includes a pipe portion which includes an intake that communicates with a sealed container containing an inert gas atmosphere and enables the inert gas to be discharged from the sealed container, and an outlet that enables the inert gas to be introduced into the sealed container, a heat exchange portion that is located partway along the pipe portion, and a gas transporting portion that is located partway along the pipe portion and is located upstream or downstream from the heat exchange portion. Accordingly, temperature exchange (namely, cooling) is possible at a faster speed than in previous cooling which uses heat transfer via inert gas (i.e., in which the interior of the sealed container is in a substantially stationary state), and a reduction in cooling time can be achieved. As a result, it is possible to provide a melting furnace that is able to efficiently cool the crucible and, consequently, enable an improvement in the work cycle to be achieved.

BRIEF DESCRIPTION OF THE DRAWING

FIG. 1 is a side view showing in typical form an example of an internal structure of the melting furnace of the present invention.

DETAILED DESCRIPTION OF THE PREFERRED EMBODIMENTS

Hereinafter, an embodiment of the melting furnace of the present invention will be described with reference made to the drawing.

FIG. 1 is a side view showing in typical form an example of an internal structure of the melting furnace according to an embodiment of the present invention.

A melting furnace 1 according to the present embodiment comprises at least a sealed container 2 containing an inert gas atmosphere (for example, argon gas or nitrogen gas), and a melting furnace body 3 that is placed inside the sealed container 2 and is used to melt raw materials.

The melting furnace body 3 has a crucible 4 and an induction coil 5. Namely, the melting furnace 1 is an induction heating type of melting furnace. The crucible 4 comprises an inside bottom surface 4*a* and a spout portion 4*b*. The induction coil 5 heats the crucible 4 to a predetermined temperature (for example, the melting point of the raw material to be melted), and the raw material that has been placed within the crucible 4 is melted so as to form a molten material.

The melting furnace 1 of the present embodiment has a crucible cooling mechanism 10 that cools the crucible 4 to a predetermined temperature (for example, a temperature at which maintenance work can be performed). This crucible cooling mechanism 10 comprises a pipe portion 13 that has an intake 11 and an outlet 12, a heat exchange portion 14, and a gas transporting portion 15. Here, both the intake 11 and the outlet 12 are communicated with the sealed container 2, and the intake 11 is used to make inert gas discharge (flow out) from the interior of the sealed container 2. The outlet 12 is used to supply inert gas to the interior of the sealed container 2. Accordingly, the intake 11 forms one end and the outlet 12 forms another end of the pipe portion 13. The heat exchange portion 14 and the gas transporting portion 15 are provided in a sequence from the intake 11 side towards the outlet 12 side partway along the pipe portion 13. Note that it is also possible for the heat exchange portion 14 and the gas transporting portion 15 to be provided in the opposite sequence, namely, for the gas transporting portion 15 and the heat exchange portion 14 to be provided in a sequence from the intake 11 side towards the outlet 12 side. Namely, the gas transporting portion 15 can be located either upstream or downstream from the heat exchange portion 14.

The intake 11 makes hot inert gas inside the sealed container 2 to be discharged (flow out) using the gas transporting portion 15. The hot inert gas that discharged from the intake 11 is introduced to the heat exchange portion 14 via the pipe portion 13, and is then cooled by the heat exchange portion 14. The inert gas that has been cooled by the heat exchange portion 14 flows into the sealed container 2 via the outlet 12 by the gas transporting portion 15.

Because the melting furnace 1 of the present embodiment has the crucible cooling mechanism 10 having the above described structure, compared with the previous case in which cooling depends on heat transfer via inert gas (i.e., in which the interior of the sealed container is in a substantially stationary state), temperature exchange (namely, cooling) is possible at a remarkably fast speed and, consequently, a reduction in cooling time can be achieved. As a result, in the melting furnace 1 according to the present embodiment it is possible to efficiently cool the crucible 4. Namely, because the interior of the sealed container 2 can be opened to the atmosphere and maintenance work performed on this interior after an extremely short cooling time, compared to a previous melting furnace, has elapsed, it is possible to improve the work cycle of the melting furnace 1 according to the present embodiment.

In addition, in the melting furnace 1, a vacuum pump 6 and an inert gas introduction pipe 7 are connected to the sealed container 2. The interior of the sealed container 2 is kept at a predetermined degree of vacuum according to a desired program, for example, after the interior of the sealed container 2 has been placed in a fixed degree of vacuum via vacuum discharge, a desired inert gas is introduced through the inert gas introduction pipe 7, and the interior of the sealed container 2 is held at a predetermined pressure.

Next, raw metal ingots (i.e., a raw material) undergo induction heating by the induction coil 5 and are melted inside the crucible 4 of the melting furnace 1.

The melting furnace body 3 of the melting furnace 1 is supported tiltably (rotatably) such that it is able to be tilted around a pivot shaft (not shown), and is tilted by a hydraulic cylinder (not shown) from the position shown by the dotted line to the position shown by the solid line in FIG. 1. Hereinafter, the state shown by the solid line in FIG. 1 is referred to as a melting state, while the state shown by the dotted line in FIG. 1 is referred to as a pouring state. Namely, in the melting state, the ingots of raw metal contained inside the crucible 4 are melted. In the pouring state, the melted material is poured out from the crucible 4.

When the obtained molten metal (i.e., the molten material) is being poured out from the melting furnace 1, the melting furnace body 3 tilts around its tilt axis (i.e., a rotation axis) from the position shown by the dotted line (i.e., from the melting state) to the position shown by the solid line (i.e. to the pouring state). Consequently, the molten metal (the molten material) is poured out from the spout portion 4*b* of the crucible 4.

Note that, although not shown in FIG. 1, a forging chamber and the like are provided adjacent to the melting furnace 1, and the molten metal poured out from the crucible 4 of the melting furnace 1 is supplied to the forging chamber through an aperture (i.e., a pouring aperture) provided in the bottom surface of the melting furnace 1.

In this manner, in order to perform maintenance work on the interior of the crucible 4 in the melting furnace 1 after raw ingots have been heated and melted therein and the resulting molten metal poured out, it is necessary to cool the crucible 4 down to a temperature at which maintenance work can be carried out. In order to actively hasten the cooling of the crucible which, in normal circumstances, only cools extremely slowly, in the present embodiment, the crucible cooling mechanism 10 is provided. Namely, after the inert gas inside the sealed container 2 has been discharged from the intake 11 of the crucible cooling mechanism 10, the inert gas has been cooled by the heat exchange portion 14 of the crucible cooling mechanism 10, and then the cooled inert gas flows into the interior of the sealed container 2. By using the crucible cooling mechanism 10 of the present embodiment, the cooled inert gas (i.e., cold wind) is blown into the interior of the crucible 4 through the outlet 12 thereby enabling the crucible 4 to be effectively cooled.

In order to generate the cooled inert gas (i.e., cold wind), the heat exchange portion 14 and the gas transporting portion 15, which is located downstream from the heat exchange portion 14, are provided partway along the pipe portion 13, which has the intake 11 and the outlet 12, in the crucible cooling mechanism 10. The heat exchange portion 14 may be a heat exchanger, and the gas transporting portion 15 may be a fan.

In this manner, in the present embodiment, the intake (i.e., the duct) 11 is located in the sealed container 2 which houses the melting furnace 3, and hot inert gas is suctioned from inside the sealed container 2 by the gas transporting portion 15, and the hot inert gas is cooled by passing through the heat exchange portion 14, and the cooled inert gas is then blown inside the crucible 4 through the outlet 12. As a result, in addition to radiation, cooling of the crucible 4 is accelerated by the heat exchange of the cooled inert gas that is blown into the crucible 4.

Moreover, since the crucible cooling mechanism 10 has the gas transporting portion (i.e., a fan) 15 and the heat exchange portion (i.e., a heat exchanger) 14, it is possible to generate inert gas which has been cooled to a desired temperature and has a desired gas circulation speed. Consequently, by blowing the inert gas (i.e. cold wind) which has been cooled to the desired temperature onto the crucible 4, the cooling curve of the crucible 4 can also be controlled. Accordingly, it becomes possible to set appropriate cooling conditions which are suitable for the material used to form the crucible 4, and for the temperature of the crucible 4 which changes from minute to minute.

Moreover, it is preferable for the outlet 12 to be positioned facing the inside bottom surface 4*a* of the crucible 4 when it is in a tilted state (i.e., in the pouring state, namely, the state of the crucible 4 shown by the solid line in FIG. 1). In a state in which the spout portion 4*b* of the crucible 4 in a tilted state is facing the bottom surface side of the sealed container 2 (i.e., in the pouring state, namely, the state of the crucible 4 shown by the solid line in FIG. 1), it is preferable for the intake 11 to be positioned closer to the bottom surface side of the sealed container 2 than is the spout portion 4*b*. Namely, in the pouring state of the crucible 4, the intake 11 is provided below the spout portion 4*b* in the pouring direction (i.e., in a direction from the top to the bottom of the drawing, namely, in a direction of gravitational force). Inside the sealed container 2, the flow path of the gas can be constructed more positively using the shape of the spout portion 4*b* of the crucible 4 (in particular, by aligning it with the direction of gravitational force). Namely, the gas (i.e., the inert gas) which is fowled out from the outlet 12 can be reliably blown onto the inside bottom surface 4*a* of the crucible 4, and the gas which has been warmed via heat transfer from the crucible 4 can be efficiently guided towards the intake 11. By employing the structure, the cooling of the crucible 4 can be accelerated.

Moreover, it is preferable for an inner diameter $d_1$ of the outlet 12 to be smaller than an inner diameter $d_2$ of the intake 11. Here, an inner diameter of a connecting portion 13*a* that connects the gas transporting portion 15 to the outlet 12 is smaller than other portions of the pipe portion 13. By narrowing the outlet 12, cooled gas can be blown onto localized portions at a fast flow rate, and can be blown reliably onto the target of the form of the crucible 4. Namely, the flow rate of the outlet 12 can be made faster than the flow rate of the intake 11. Moreover, localized jets can be reliably blown onto a target portion, namely, onto 'a desired position on the inside bottom surface 4*a* of the crucible 4'. In the present embodiment, in order for cooled inert gas to be blown onto localized portions at a fast flow rate, the inner diameter of the connecting portion 13*a* has been narrowed down, however, the present embodiment is not limited to this and it is also possible to provide a mechanism that increases the flow rate of inert gas in the connecting portion 13*a*. For example, it is possible to provide ribs inside the connecting portion 13*a*.

In particular, it is preferable for the outlet 12 to be provided such that the airflow discharged from the outlet 12 is blown onto an area within 40% of the diameter from the center of the inside bottom surface 4*a* of the crucible 4.

By employing a structure in which the discharged airflow is blown onto an area that inside 40% of the diameter from the center of the inside bottom surface 4*a* of the crucible 4, the discharged air flow can be blown directly at the crucible 4 without any deviation.

Accordingly, when the crucible 4 is being cooled, there is no unevenness in the cooling state of the crucible 4 (for example, a state in which one half of the crucible 4 is at a higher temperature than the other half). As a result, it is possible to suppress any damage to the crucible 4 (for example, cracks and fractures and the like) which may be caused by this uneven cooling state, and the number of times the crucible 4 can be reused can be increased. Namely, a lengthening of the lifespan of the crucible 4 can be achieved.

Once the crucible 4 has been sufficiently cooled to a temperature at which maintenance work can be carried out, the lid (not shown) of the sealed container 2 is opened and maintenance work is begun. In the present embodiment, because it is possible to accelerate the cooling of the crucible 4 in the manner described above, the wait time until the maintenance work can be started is considerably reduced and, as a result of this, the works cycle can be shortened and a corresponding improvement in productivity can be achieved.

An embodiment of the present invention has been described above, however, the present invention is not limited to this and various modifications are possible based on the technological considerations of the present invention.

[Industrial Applicability]

The present invention can be broadly applied to induction heating-type melting furnaces that have crucibles that are placed inside a sealed container.

[Description of the Reference Numerals]

1 Melting furnace
2 Sealed container
3 Melting furnace body
4 Crucible
5 Induction coil
10 Crucible cooling mechanism
11 Intake
12 Outlet
13 Pipe portion
14 Heat exchange portion (Heat exchanger)
15 Gas transporting portion (Fan)

What is claimed is:

1. A melting furnace comprising:

a sealed container containing an inert gas atmosphere;

a crucible that is located inside the sealed container and melts a raw material by induction heating; and a crucible cooling mechanism, comprising:

a pipe portion that includes an intake that communicates with the sealed container and that enables the inert gas to be discharged from the sealed container, and an outlet that enables the inert gas to be introduced into the sealed container;

a heat exchange portion that is located partway along the pipe portion; and a gas transporting portion that is located partway along the pipe portion, wherein the outlet is positioned proximate to a top region of the sealed container and is facing an inside bottom surface of the crucible when the crucible is in a pouring state; and when the crucible is in the pouring state and a spout portion of the crucible is facing towards the bottom surface side of the sealed container, the intake is positioned proximate to a bottom region of the sealed container below the spout portion in order that the gas is circulated positively in the sealed container and the crucible cooling mechanism.

2. The melting furnace according to claim 1, wherein the gas transporting portion of the crucible cooling mechanism is located upstream or downstream from the heat exchange portion.

3. The melting furnace according to claim 1, wherein an inner diameter of the outlet is smaller than an inner diameter of the intake.

4. The melting furnace according to claim 1, wherein the outlet blows the inert gas at a greater flow rate than the intake.

5. The melting furnace according to claim 1, wherein the crucible tilts around a tilt axis so as to switch between a melting state and a pouring state.

6. The melting furnace according to claim 1, wherein the crucible comprises the inside bottom surface and the spout portion from which the melted raw material poured out.

7. The melting furnace according to claim 1, wherein the intake is positioned below a spout portion of the crucible in a direction which the melted raw material is poured out.

8. The melting furnace according to claim 1, wherein the outlet is positioned such that the inert gas discharged from the outlet is blown onto an area within 40% of a diameter from a center of the inside bottom surface of the crucible.

9. The melting furnace according to claim 1, wherein the heat exchange portion and the gas transporting portion of the crucible cooling mechanism are located between the intake and the outlet of the pipe portion.

10. The melting furnace according to claim 1, wherein the heat exchange portion has a heat exchanger, and the gas transporting portion has a fan.

* * * * *